US006969069B2

(12) United States Patent
Norman

(10) Patent No.: US 6,969,069 B2
(45) Date of Patent: Nov. 29, 2005

(54) PLAYING PIECE

(75) Inventor: Casey Norman, Andoversford (GB)

(73) Assignee: Genie Toys, plc., (GB)

( * ) Notice: Subject to any disclaimer, the term of this patent is extended or adjusted under 35 U.S.C. 154(b) by 0 days.

(21) Appl. No.: 10/781,603

(22) Filed: Feb. 18, 2004

(65) Prior Publication Data

US 2005/0110216 A1 May 26, 2005

(30) Foreign Application Priority Data

Nov. 20, 2003 (GB) ..... 0327052
Jan. 21, 2004 (GB) ..... 0401314

(51) Int. Cl.[7] ..... A63F 9/00
(52) U.S. Cl. ..... 273/447; D21/386
(58) Field of Search ..... 273/447, 108, 273/118 R, 353, 317, 440, 441, 459, 288, 273/289; 446/376–383, 386, 308, 309, 486, 446/491; D21/385, 386

(56) References Cited

U.S. PATENT DOCUMENTS 1,579,367 A * 4/1926 Hymer ..... 446/376
D70,800 S * 8/1926 McDonald ..... D21/386
2,286,368 A * 6/1942 May ..... 434/159
3,017,182 A * 1/1962 Milan ..... 273/409
4,190,982 A 3/1980 Rahmstorf
4,827,575 A 5/1989 Delaney
4,902,022 A * 2/1990 Salmon ..... 273/317
4,986,539 A * 1/1991 Jackson ..... 273/455
6,318,725 B1 * 11/2001 Saint-Victor ..... 273/447

FOREIGN PATENT DOCUMENTS

GB 2 113 561 A 8/1983

OTHER PUBLICATIONS http://www.frogstore.com/products/FG1772JJ.asp.
"Animal Jacks" advertised on Toy Treasure House website [http://www.toytreasurehouse.com/xcart/catalog/product_16262_Animal_Jacks.html].
"ProjaX" (RTM) game pieces marketed by Hasbro (RTM), e.g., as shown on http://www.playprojax.com, undated.
"Seattle Cosmic Game Night (Sat., Nov. 18, 2000)—The Cetacean Invasion and Groo Wreak Havoc" by Ron Hale-Evans [http://www.ludism.org/sc/2000-11-18.html].
"Pass the Pigs" (RTM) game, e.g., as shown on "BoardGameGeek.com" [http://www.boardgamegeek.com/].

* cited by examiner

*Primary Examiner*—Raleigh W. Chiu
(74) *Attorney, Agent, or Firm*—DLA Piper Rudnick; Gray Cary US LLP

(57) ABSTRACT

A set of playing pieces for a game of jacks or the like, wherein each playing piece is in the form of a multi-point jack having portions defining at least four extremities spaced at least approximately equi-angularly about, and at at least approximately the same distance from a central core. The extremities allow tripodal support of the multi-point jack on the flat surface in different orientations. The playing piece is in the form of a figurine and at least some of said extremity-defining portions are differently shaped.

12 Claims, 8 Drawing Sheets

(b)

(a)

PLAYING PIECE

FIELD OF THE INVENTION

This invention relates to a playing piece for a game of jacks or the like, the playing piece being of the kind which is in the form of a multi-point jack having portions defining at least four extremities spaced at least approximately equi-angularly about, and at least approximately the same distance from, a central point, the extremities allowing tripodal support of the multi-point jack on a flat surface in different orientations.

BACKGROUND

The game of jacks, sometimes referred to as "fivestones," has been known for many hundreds if not thousands of years. The game is well known and will not be described in detail, but involves players picking up jacks scattered on the floor or playing surface and/or throwing jacks in the air and catching them on the back of the hand. Traditionally the so-called "jacks" were stones which, of course, were never in a uniform shape or size. Nowadays, however, jacks of the kind referred to are generally equally sized, made of plastics or metallic materials and have six equally-sized orthogonal arms each comprising a generally circularly cylindrical rod terminating at its free end in a ball-shaped tip or extremity having a diameter slightly larger than that of the rod.

SUMMARY OF THE INVENTION

This invention relates to a playing piece for a game including a multi-point jack having portions defining at least four extremities spaced at least approximately equi-angularly from one another and at at least approximately the same distance from, a central point in the multi-point jack. The extremities allow tripodal support of the multi-point jack on a flat surface in different orientations. The playing piece is a figurine and at least some of the extremity-defining portions are differently shaped.

BRIEF DESCRIPTION OF THE DRAWINGS

Embodiments of the invention will now be described, by way of example only with particular reference to the accompanying drawings in which.

DETAILED DESCRIPTION

According to one aspect of the invention, there is provided a playing piece for a game of jacks, or the like, the playing piece being in the form of a multi-point jack having portions defining at least four extremities spaced at least approximately equi-angularly about, and at least approximately the same distance from a central point, the extremities allowing tripodal support of the multi-point jack on a flat surface in different orientations, wherein the playing piece is in the form of a figurine and at least some of the extremity-defining portions are differently shaped.

The term "figurine" means a small molded or carved model or figure representing a human, a human-like character, a science fiction character, an animal, a mythical or make-believe character, a mythical creature, a cartoon creature, a body part or parts, a machine, an object, a vehicle or combinations thereof. Examples of figurines, include, but are not limited to, science fiction warriors carrying objects, such as weapons, or seated on vehicles, such as space vehicles.

Suitably, the playing piece has a central core and at least four spurs extending outwardly therefrom and terminating in the said extremities. Typically, the playing piece has 4 or 6 spurs terminating in 4 or 6 extremities respectively.

If provided with outwardly extending spurs, the spurs may extend substantially radially from the core, in which case they are arranged at at least approximately equal angles to each other to enable tripodal support in different orientations of the playing piece. In the case of a playing piece having four radial spurs, the spurs are arranged at at least approximately 120° to each other. In the case of a playing piece having six radical spurs, the spurs are arranged at least approximately orthogonally to each other.

Suitably, the playing pieces are made of metal, plastic material or a resilient material such as rubber or the like.

In an embodiment of the invention, the playing pieces are formed from at least two component parts. The parts may be interchangeable and/or may be moveable between different mutual configurations, for example, by rotating with respect to each other.

According to another aspect of the invention there is provided a set of playing pieces each according to the one aspect of the invention, the playing pieces of the set being of different figurines.

Figure 1:
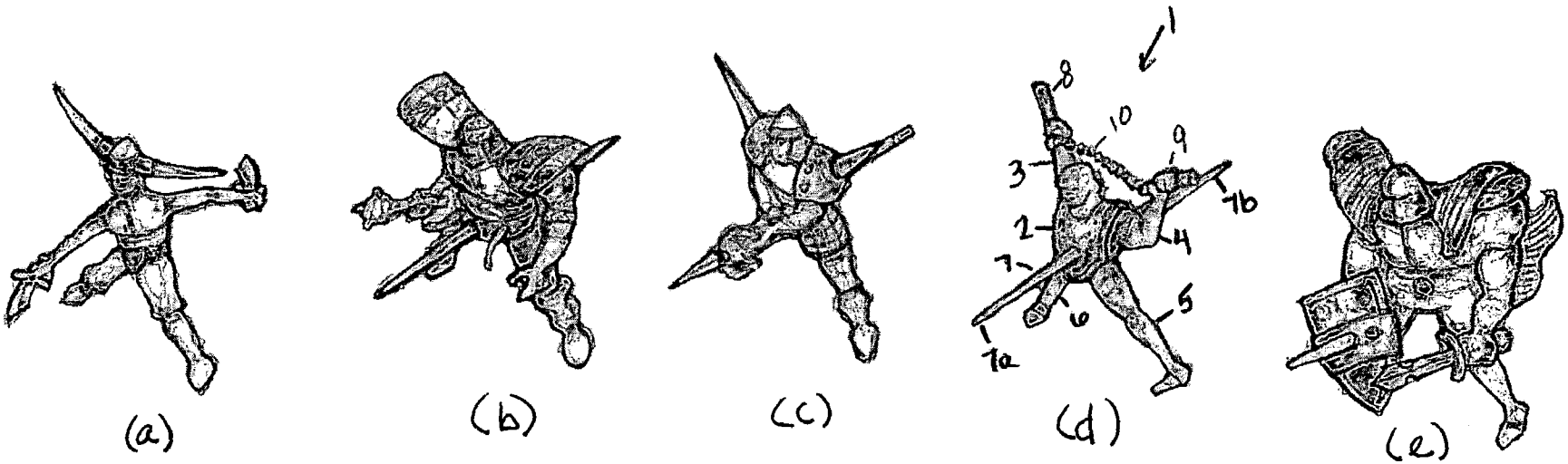
FIGS. 1(*a*)–(*e*), 2(*a*)–(*e*), 3(*a*)–(*e*), 4(*a*)–(*e*), 5(*a*)–(*e*) and 6(*a*)–(*e*) are perspective views of six different sets of playing pieces, each according to aspects of the invention.

Turning now to the drawings, the five playing pieces shown in FIGS. 1(*a*)–(*e*) constitute a set of six-point jacks. Each of the playing pieces is of a different design of figurine although all are of the same general theme, namely armed warrior figurines. Since the playing pieces of the set are of a similar general design, only playing piece 1 shown in FIG. 1(*d*) is described in detail. It will be appreciated, however, that the other playing pieces of the set have similar features albeit that they are of different figurines.

Playing piece 1 has a central core 2 with six generally radial spurs extending therefrom in the form of a raised arms 3 and 4, spread apart legs 5 and 6 and a lance 7 appearing to pass through the central core 2 and having lance portions 7(*a*) and 7(*b*). The warrior figurine carries a weapon of bars 8 and 9, joined together by a chain 10, the bars 8 and 9 forming extensions of the arms 3 and 4, respectively. The six spurs of the playing piece 1 are arranged generally orthogonally to each other. In particular, the spurs formed by the two legs 5 and 6 and the arms 3 and 4 with their extensions provided by the bars 8 and 9, respectively, are arranged in a common plane. The lance portions 7(*a*) and 7(*b*) extend in opposite directions substantially perpendicularly to this common plane. The free ends or extremities of these six spurs, formed by the ends of the bars 8 and 9, the toes at the ends of the legs 5 and 6 and the tips of the lance portions 7(*a*) and 7(*b*), are substantially equi-angularly spaced apart about, and at least approximately equi-distant from a central point, typically within the central core 2.

When the playing piece 1 is thrown in the air and subsequently lands on a flat surface, the playing piece comes to rest supported on three of these spur extremities which provide tripodal support. The playing piece can be supported in different orientations with sets of three extremities providing tripodal support. It will be appreciated that the various spurs of the playing piece 1 are of a different form or design so that the figurine is completely different from a conventional symmetrical six-point jack and enables the jack to be made in the form of a figurine.

Preferably, a playing piece is manufactured with the extremities of the various spurs at precisely the same distance from a central point and at equal spacing apart from each other and with the spurs equi-angularly spaced from each other. However, it will be appreciated that this may not always be possible to achieve from both a manufacturing point of view and from the design point of view in manufacturing a particular design of figurine. For this reason, the spacing apart of the extremities from each other and from the central point and the angular spacing of the spurs may be slightly different, but will be at least approximately the same.

Figure 2:
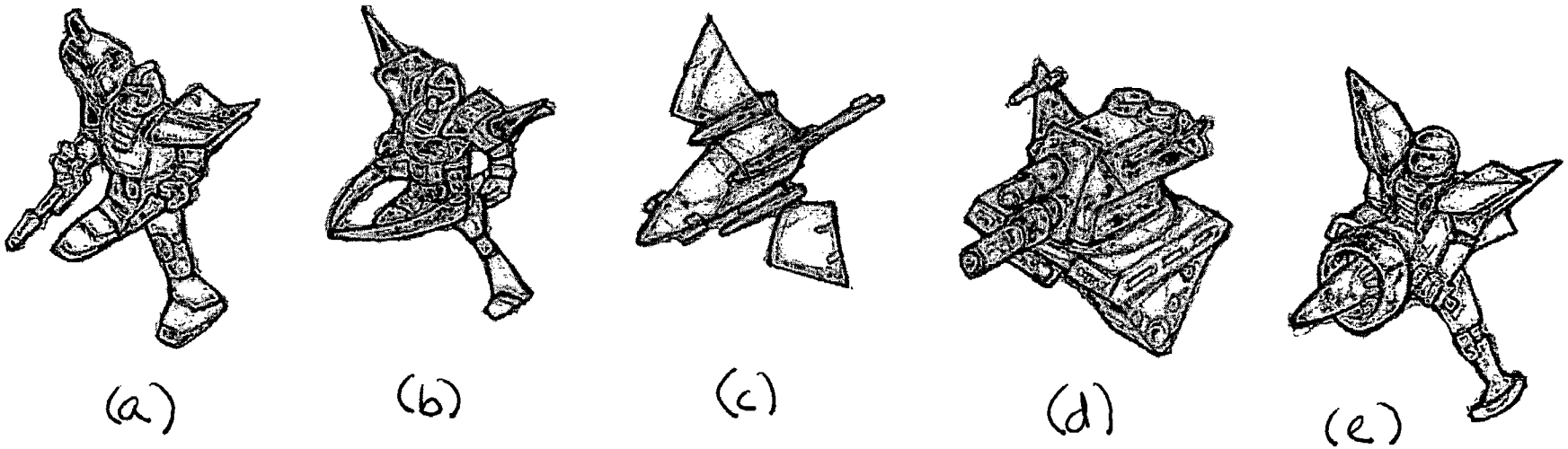
Figure 3:
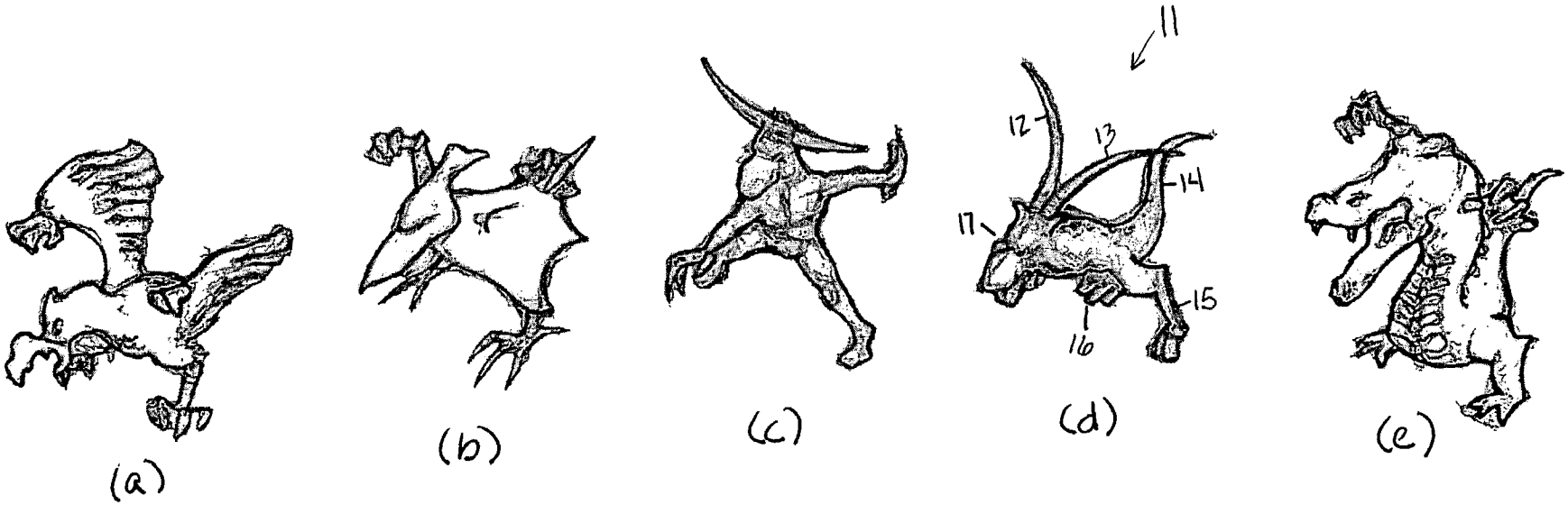

The playing pieces of FIGS. 2(*a*)–(*e*) and FIGS. 3(*a*)–(*e*) show two different sets of six-point jacks, each jack being in the form of a figurine. The five playing pieces of each set have a common theme, the figurine of FIGS. 2(*a*)–(*e*) being space warriors and/or space vehicles and the figurine of FIGS. 3(*a*)–(*e*) being prehistoric or mythical creatures. Each playing piece shown in FIGS. 2(*a*)–(*e*) has generally radially extending spurs terminating in tips or extremities which are substantially equi-angularly spaced about, and at least approximately equally spaced from a central point. These extremities are also at least approximately equally spaced from each other and provide tripodal support of the playing piece on a flat surface in different orientations of the playing piece. The playing pieces shown in FIGS. 3(*a*)–(*e*), in contrast, do not all have true radially extending spurs. For instance, the creature-like figurine of the playing piece 11 shown in 3(*d*) has arcuate shaped horns 12 and 13, a curly tail 14, angled legs 15 and 16 and an angled neck and head part 17. However, the tips or extremities of these differently shaped parts are intended to be substantially equally spaced apart to facilitate the playing piece landing in a random orientation, supported by three of the tips, after being thrown in the air.

Figure 4:
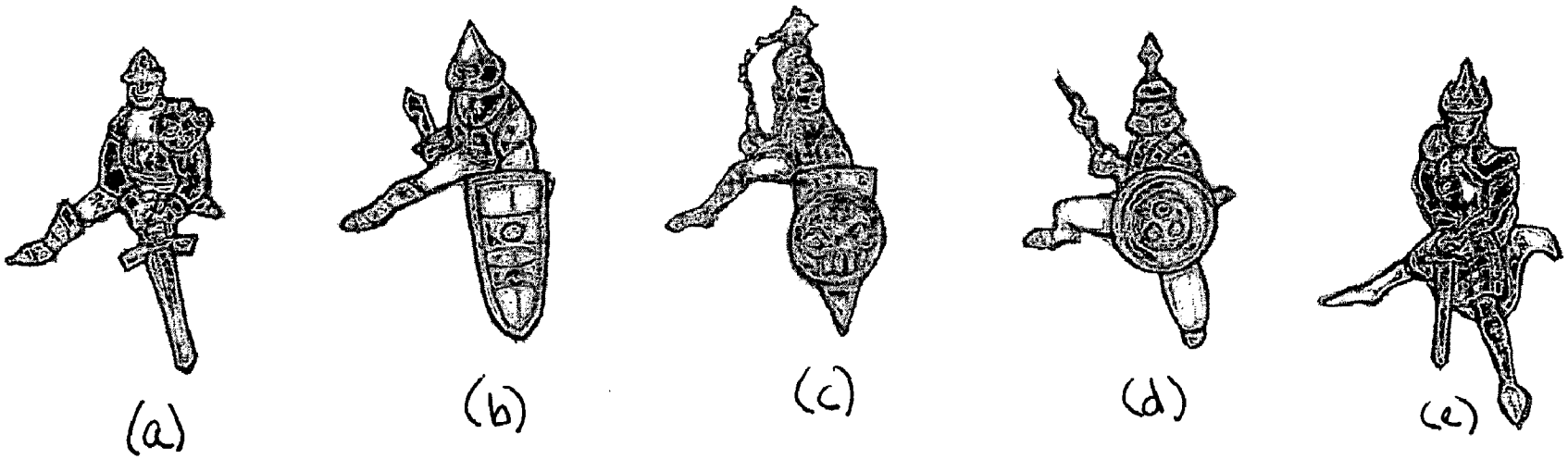
Figure 5:
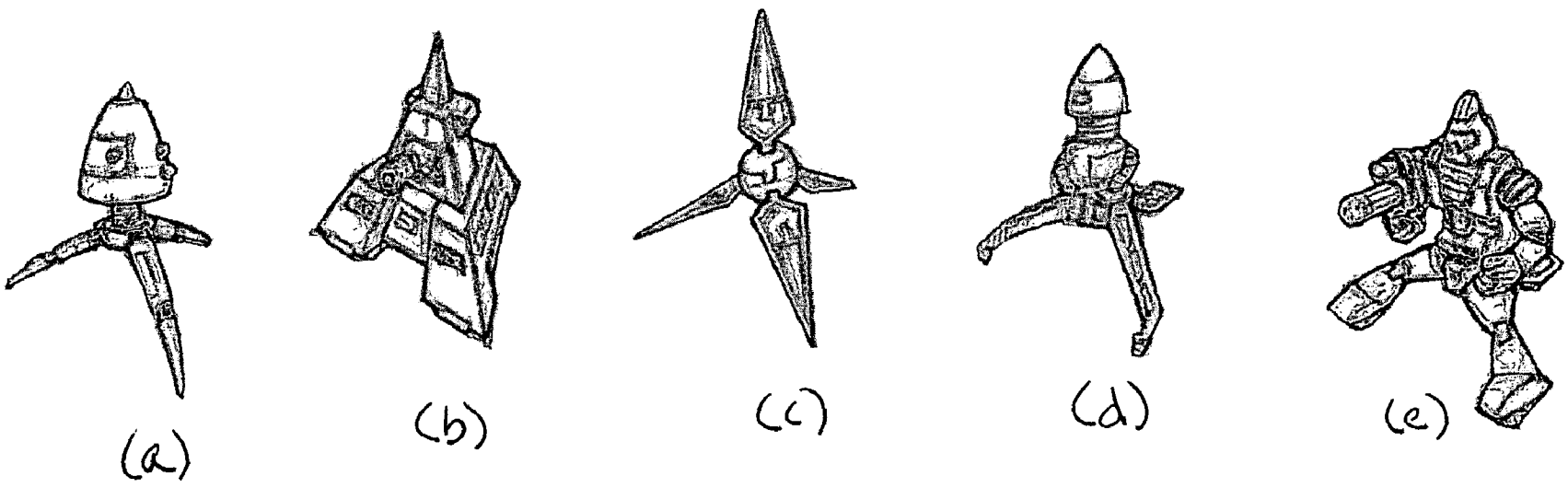
Figure 6:
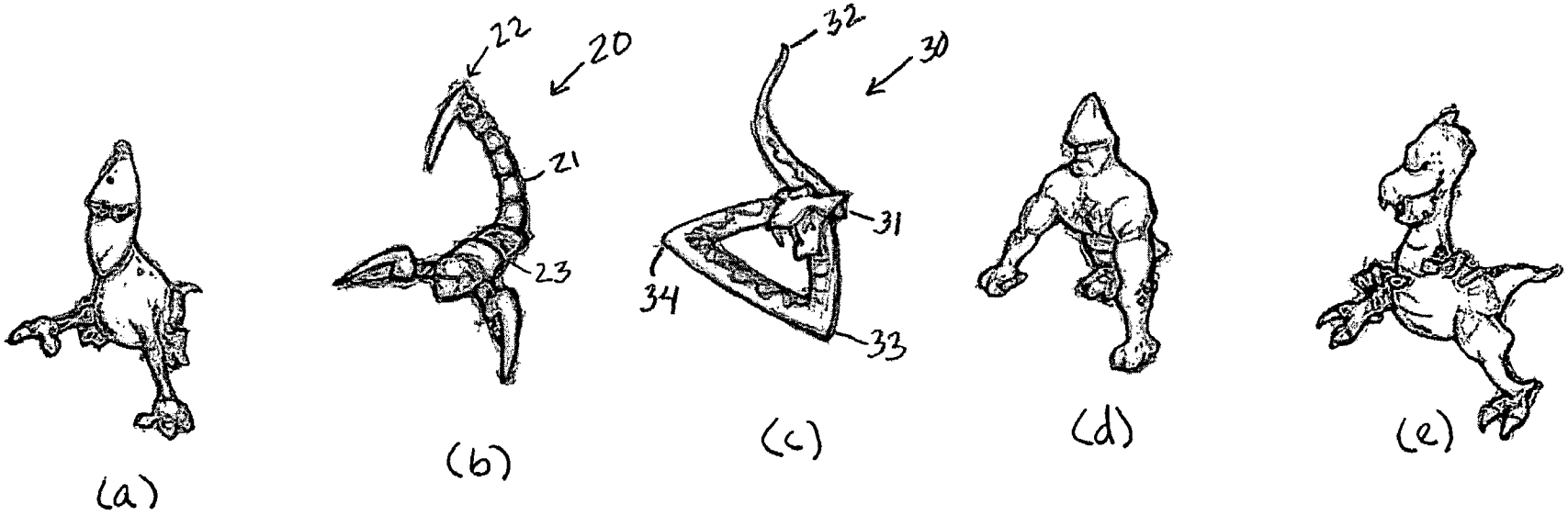

The playing pieces of FIGS. 4(*a*)–(*e*), FIGS. 5(*a*)–(*e*) and FIGS. 6(*a*)–(*e*) show three further different sets of five jacks which have a common theme in their designs or configurations to the sets of jacks shown in FIGS. 1(*a*)–(*e*), FIGS. 2(*a*)–(*e*) and FIGS. 3(*a*)–(*e*), respectively. However the jacks shown in FIGS. 4(*a*)–(*e*), FIGS. 5(*a*)–(*e*) and FIGS. 6(*a*)–(*e*), although all being in the form of figurines, are all four-point design instead of the six-point design described previously.

Most of the four-point jacks or playing pieces shown each have a central core from which four "arms" or spurs extend outwardly and terminate in tips or extremities which are at least approximately equi-angularly orientated about, and at least substantially equally spaced from, a central point, typically within the central core. If these spurs extend radially outwardly, they subtend angles of approximately 120° to each other. However, as illustrated in FIG. 6(*b*), in particular, the creature in figurine 20 has a curved tail 21 which is bent over the end and defines an extremity 22 which is not the actually tip of the tail. Although the figurine 20 has a core 23 from which four spurs, including the tail 21, extend outwardly, the creature figurine 30 shown in FIG. 6(*c*) is in the form of a snake having no central core as such. Instead the figurine 30 is generally elongate and has a head 31 and a tail 32 defining two of the four extremities with its body bent to define the other two extremities 33 and 34. The extremities are at least approximately equi-angularly oriented about, and at least approximately equally spaced apart from, a central point surrounded by, but not part of, the figurine.

Figure 7:
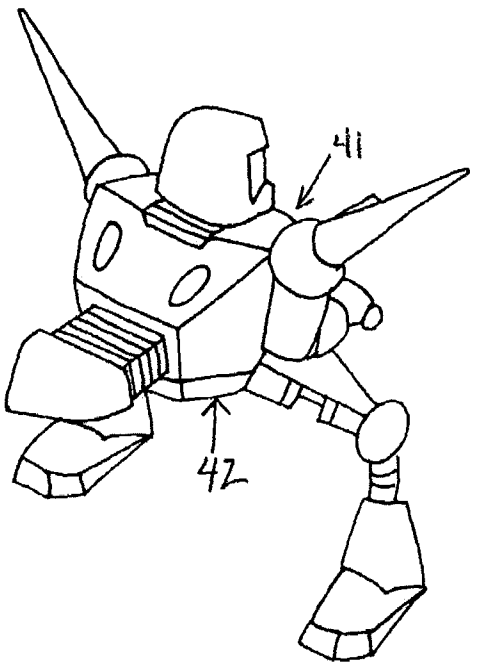
FIGS. 7(*a*), 7(*b*) and 8(*a*)–(*f*) are perspective views of playing pieces according to other aspects of the invention.
Figure 7:
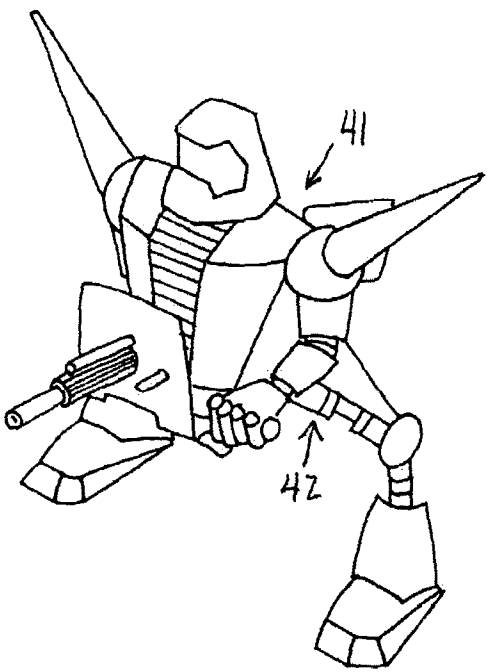

FIGS. 7(*a*) and 7(*b*) show a jack similar to those described above, but made from an upper part 41 and a lower part 42, attached together to make up the final shape. The two parts 41, 42 can be mutually rotated at the waist of the figurine through 180° so that the upper part 41 of the figurine in FIG. 7(*b*) is facing in the opposite direction to FIG. 7(*a*). The reason for doing this might be to enhance or vary the subsequent game play.

Figure 8:
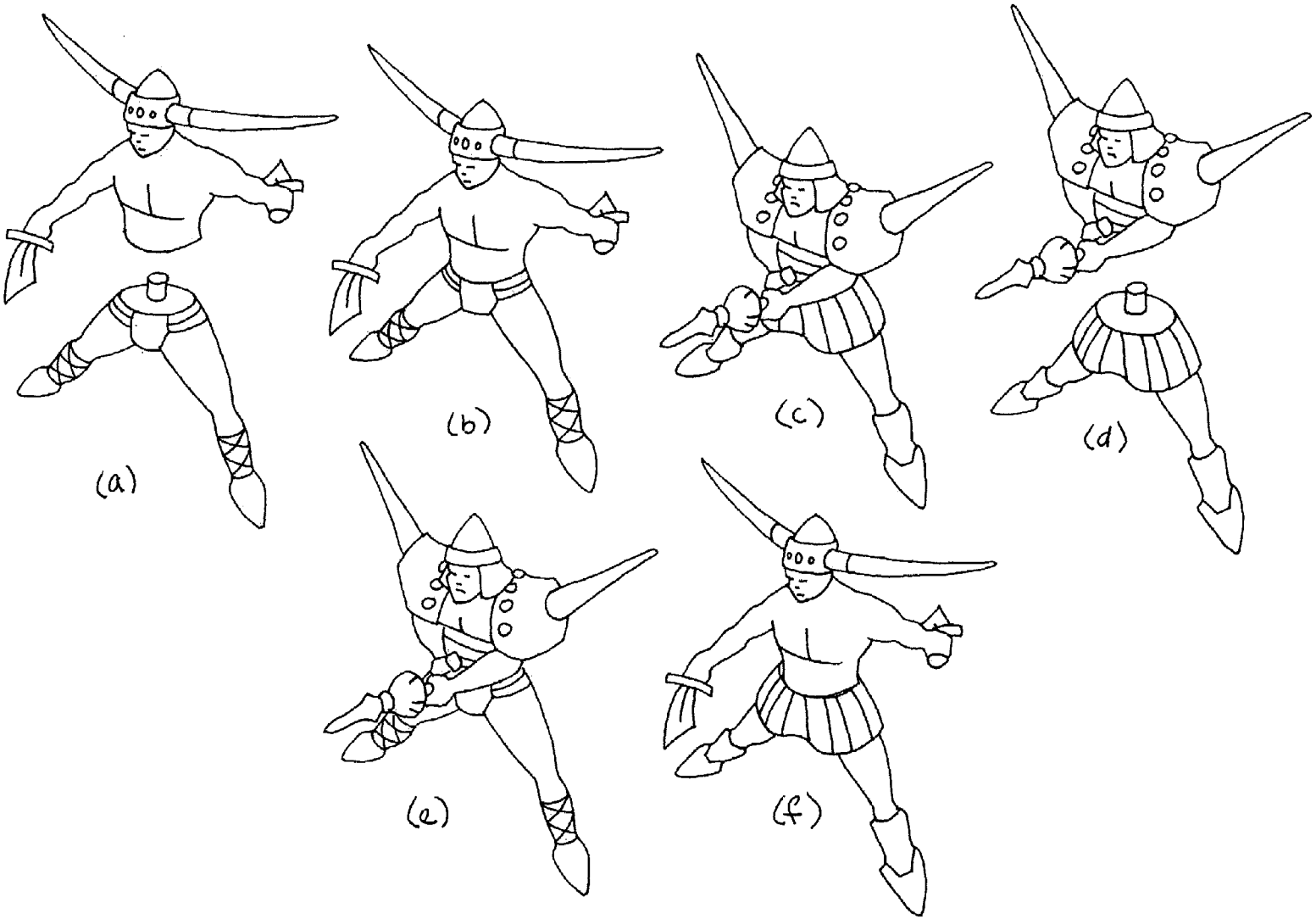

FIGS. 8(*a*)–(*e*) show a further variant in which the upper and lower halves are detachable and interchangeable between playing pieces. Thus, FIGS. 8(*a*) and 8(*c*) show detached parts of two different figurines, FIGS. 8(*b*) and 8(*d*) show the assembled figurines and FIGS. 8(*e*) and 8(*f*) show new figurines created by interchanging the parts of FIGS. 8(*a*) and 8(*c*).

The playing pieces are suitably molded from plastic material although they can be metal cast or made from other materials, such as resilient material, such as rubber or the like.

Although the invention has been described with reference to 4-point and 6-point playing pieces, it will be appreciated by those skilled in the art that other configurations are possible provided that there are at least four "points" or extremities of the playing piece which are at least approximately equi-angularly orientated about, and at least approximately equally spaced from, a central point and allow tripodal support of the playing piece in different orientations.

The key features of the invention are the provision of collectable figurines in different sets. One of the jacks of a set may be made of a larger size than the other jacks of the set. Instead of each jack or playing piece being of a conventional, regular six-point form, the jacks comprise figurines of non-symmetrical form with figurines of preferably different design with a set. Thus, the playing pieces of a set are collectable items while still being usable in the game of jacks. The points or extremities of the playing piece enable it to be supported on a flat surface in different orientations by means of tripodal support. Thus, in addition to being used for playing conventional jacks, the playing pieces provide the possibility for further game plays dependent on the orientation of the playing pieces, e.g., facing up or down, on their sides or the like, when they land after being thrown in the air. In particular, different scores can be obtained depending on the orientation of the playing pieces when they land after having been thrown in the air. Games based on the game of jacks may also be devised by using sets of playing pieces in battle arenas in which the playing pieces are thrown and collected.

What is claimed is:

1. A playing piece for a game comprising a multi-point figurine having portions defining at least six extremities spaced at least approximately equi-angularly from one another and at least approximately the same distance from a central point in the figurine and a central core and at least six spurs extending outwardly therefrom and terminating in the extremities, all of the extremities shaped to form an entire character of the figurine and allowing tripodal support of the figurine on a flat surface in different orientations.

2. The playing piece according to claim 1, wherein the figurine represents a human, a human-like character, a science fiction character, an animal, a mythical or make-believe character, a mythical creature, a cartoon character, or a cartoon creature.

3. A set of playing pieces comprising a plurality of the playing pieces according to claim 1, wherein the playing pieces are of different figurines.

4. The playing piece according to claim 1, wherein the figurine represents a body part or parts, a machine, an object or a vehicle.

5. The playing piece according to claim 1, wherein the spurs extend substantially radially from the core and are arranged at at least approximately equal angles to each other to enable tripodal support in different orientations of the playing piece.

6. The playing piece according to claim 1, formed from at least two component parts.

7. The playing piece according to claim 1, made from metal, plastic material or a resilient material.

8. The playing piece according to claim 7 wherein the resilient material is rubber.

9. A playing piece for a game comprising a multi-point jack formed from at least two component parts that are movable between different mutual configurations and having portions defining at least four extremities based at least approximately equi-angularly from one another and at least approximately the same distance from a central point in the multi-point jack, the extremities allowing tripodal support of the multi-point jack on a flat surface in different orientations, wherein the playing piece is a figurine and at least some of the extremity-defining portions are differently shaped.

10. The playing piece according to claim 9, wherein the parts are mutually rotatable.

11. A set of playing pieces comprising a plurality of playing pieces, each playing piece comprising a playing piece for a game comprising a multi-point jack formed from at least two component parts that are movable between different mutual configurations and having portions defining at least four extremities based at least approximately equi-angularly from one another and at least approximately the same distance from a central point in the multi-point jack, the extremities allowing tripodal support of the multi-point jack on a flat surface in different orientations, wherein the playing piece is a figurine and at least some of the extremity-defining portions are differently shaped, wherein the playing pieces are of different figurines.

12. A playing piece for a game comprising a multi-point figurine having portions defining at least six extremities spaced at least approximately equi-angularly from one another and at least approximately the same distance from a central point in the figurine and a central core and at least six spurs extending outwardly therefrom and terminating in the extremities, all of the extremities shaped to form an entire character of the figurine and allowing tripodal support of the figurine on a flat surface in all different orientations.

* * * * *